US006584985B2

(12) United States Patent
Omura

(10) Patent No.: US 6,584,985 B2
(45) Date of Patent: Jul. 1, 2003

(54) BEAUTY APPLIANCE

(75) Inventor: Shingo Omura, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/983,199

(22) Filed: Oct. 23, 2001

(65) Prior Publication Data

US 2002/0056466 A1 May 16, 2002

(30) Foreign Application Priority Data

Oct. 26, 2000 (JP) ..... 2000-327771

(51) Int. Cl.[7] ..... A45D 19/16; A45D 19/18; A45D 20/08; A45D 3/00

(52) U.S. Cl. ..... 132/272; 132/271; 132/270; 219/222

(58) Field of Search ..... 132/272, 271, 132/270, 212, 221, 228, 229, 227; 219/222

(56) References Cited

U.S. PATENT DOCUMENTS 5,010,905 A * 4/1991 Snyder et al. ..... 132/272
5,241,974 A * 9/1993 Tsai ..... 132/272
5,584,307 A * 12/1996 Bauer et al. ..... 132/113
5,715,360 A * 2/1998 Montagnino ..... 392/403
6,024,100 A * 2/2000 Fukuyama ..... 132/200
6,152,146 A * 11/2000 Taylor et al. ..... 132/116

FOREIGN PATENT DOCUMENTS

| | | |
|---|---|---|
| JP | 1-68039 | 5/1989 |
| JP | 4-56417 | 5/1992 |

* cited by examiner

*Primary Examiner*—John J. Wilson
*Assistant Examiner*—Robyn Kieu Doan
(74) *Attorney, Agent, or Firm*—Oblon, Spivak, McClelland, Maier & Neustadt, P.C.

(57) ABSTRACT

A beauty appliance includes a steam ejection device and a mist ejection device. The steam ejection device includes a steam ejection nozzle through which steam is configured to be ejected. The mist ejection device includes a mist ejection nozzle through which the liquid is configured to be ejected as mist and which is positioned in relation to the steam ejection nozzle such that ejection flow of the steam in the steam ejection nozzle causes a flow of the liquid toward the mist ejection nozzle from a mist liquid tank.

25 Claims, 12 Drawing Sheets

BEAUTY APPLIANCE

CROSS-REFERENCE TO RELATED APPLICATIONS

The present application claims priority under 35 U.S.C. § 119 to Japanese Patent Application No. 2000-327771, filed Oct. 26, 2000, entitled "BEAUTY APPLIANCE, HAIR DRYER WITH BRUSH, AND APPLIANCE FOR BEAUTIFYING FACE." The contents of this application are incorporated herein by reference in their entirety.

BACKGROUND OF THE INVENTION

1. Field of the Invention

The present invention relates to a beauty appliance.

2. Discussion of the Background

FIG. 16 shows a conventional hair dryer or a hair setter with a brush. Referring to FIG. 16, The hair dryer 100 includes a steam water tank 102, a porous material 104 and a heater 106. Water stored in the steam water tank 102 is supplied to the heater 106 via the porous material 104. The heater 106 heats the water to generate steam.

SUMMARY OF THE INVENTION

According to one aspect of the present invention, a beauty appliance includes a steam ejection device and a mist ejection device. The steam ejection device includes a steam water tank, a heater and a steam ejection nozzle. The steam water tank is configured to contain water therein. The heater is configured to heat the water to generate steam. The steam is configured to be ejected through the steam ejection nozzle. The mist ejection device includes a mist liquid tank and a mist ejection nozzle. The mist liquid tank is configured to contain liquid therein. The liquid is configured to be ejected as mist through the mist ejection nozzle. The mist ejection nozzle is positioned in relation to the steam ejection nozzle such that ejection flow of the steam in the steam ejection nozzle causes a flow of the liquid toward the mist ejection nozzle from the mist liquid tank.

According to another aspect of the present invention, a beauty appliance includes a steam ejection device and a mist ejection device. The steam ejection device includes a steam generating chamber, a water absorbing material, a heater and a steam ejection nozzle. The water absorbing material is provided in the steam generating chamber and configured to absorb water. The heater is provided in the steam generating chamber and configured to heat the water absorbing material to generate steam. The steam ejection nozzle is connected to the steam generating chamber. The steam is configured to be ejected through the steam ejection nozzle. The mist ejection device includes a mist liquid tank and a mist ejection nozzle. The mist liquid tank is configured to contain liquid therein. The liquid is configured to be ejected as mist through the mist ejection nozzle. The mist ejection nozzle is positioned in relation to the steam ejection nozzle such that ejection flow of the steam in the steam ejection nozzle causes a flow of the liquid toward the mist ejection nozzle from the mist liquid tank.

According to yet another aspect of the present invention, a beauty appliance includes a steam ejection device and an air ejection device. The steam ejection device includes a steam water tank, a heater and a steam ejection nozzle. The steam water tank is configured to contain water therein. The heater is configured to heat the water to generate steam. The steam is configured to be ejected through the steam ejection nozzle. The air ejection device includes an air intake passage and an air ejection nozzle. The air intake passage communicates with an atmosphere. The air ejection nozzle is connected to the air intake passage and is positioned in relation to the steam ejection nozzle such that ejection flow of the steam in the steam ejection nozzle causes a flow of air toward the air ejection nozzle via the air intake passage.

According to the other aspect of the present invention, a beauty appliance includes a steam ejection device and a mist ejection device. The steam ejection device includes a steam water tank, a heater and a steam ejection nozzle. The steam water tank is configured to contain water therein. The heater is configured to heat the water to generate steam. The steam is configured to be ejected through the steam ejection nozzle. The mist ejection device includes a mist liquid tank and a mist ejection nozzle. The mist liquid tank is configured to contain liquid therein. The liquid is configured to be ejected through the mist ejection nozzle. The mist ejection nozzle is positioned in relation to the steam ejection nozzle such that a mist amount ejected from the mist ejection nozzle depends on a flowing speed of the steam in the steam ejection nozzle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2(*b*) is a cross-sectional view of a mist liquid tank of the beauty appliance which is rotated 90° around the X-axis;

FIG. 3(*b*) is a cross-sectional view of a mist liquid tank of the beauty appliance which is rotated 90° around the Z-axis;

FIG. 15(*b*) is a cross-sectional view of the dryer with a brush taken along a line X—X.

DESCRIPTION OF THE PREFERRED EMBODIMENTS

Figure 1:
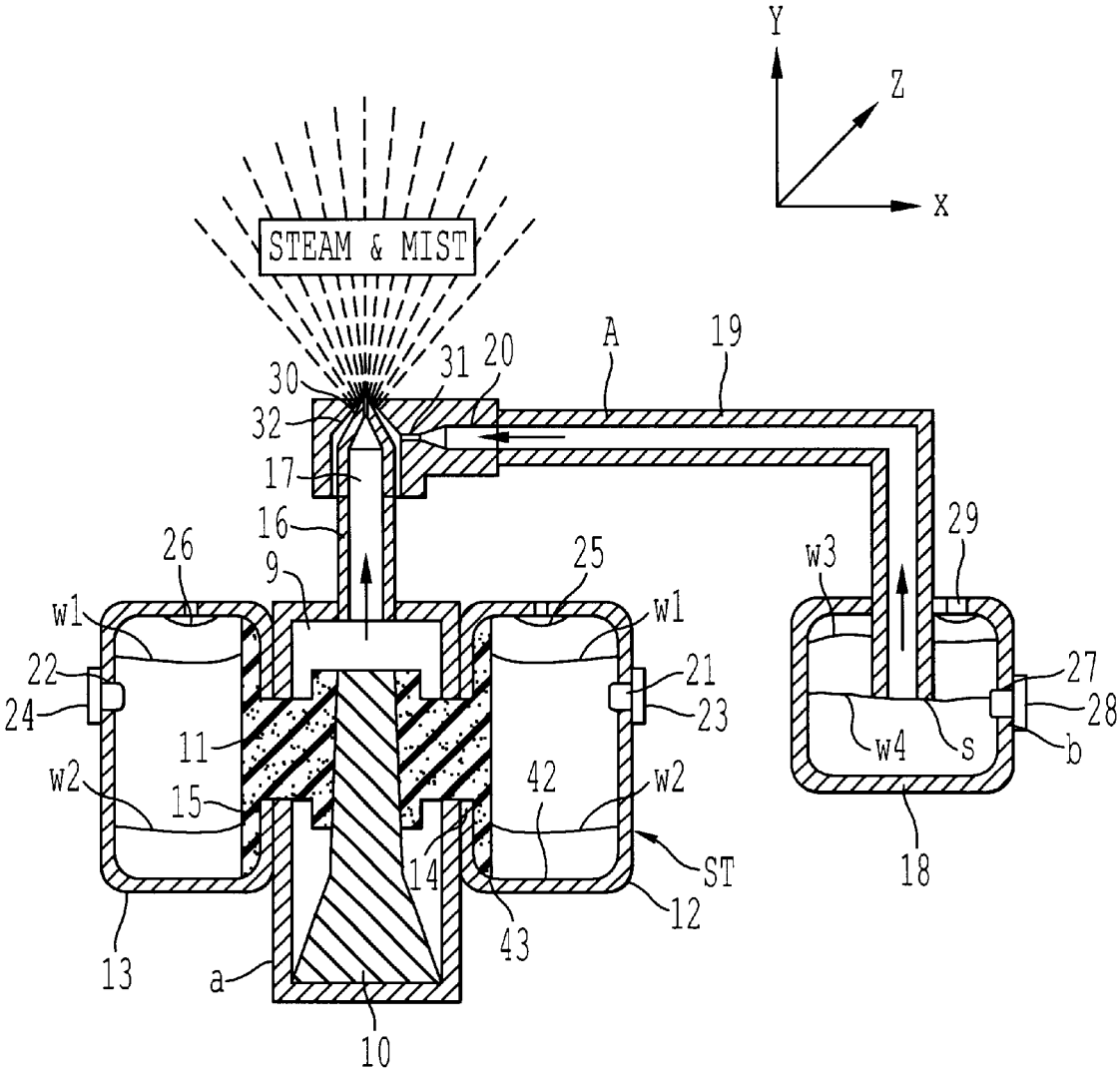
FIG. 1 is a cross-sectional view of a beauty appliance according to an embodiment of the present invention.

The preferred embodiments will now be described with reference to the accompanying drawings, wherein like reference numerals designate corresponding or identical elements throughout the various drawings.

Figure 2A:
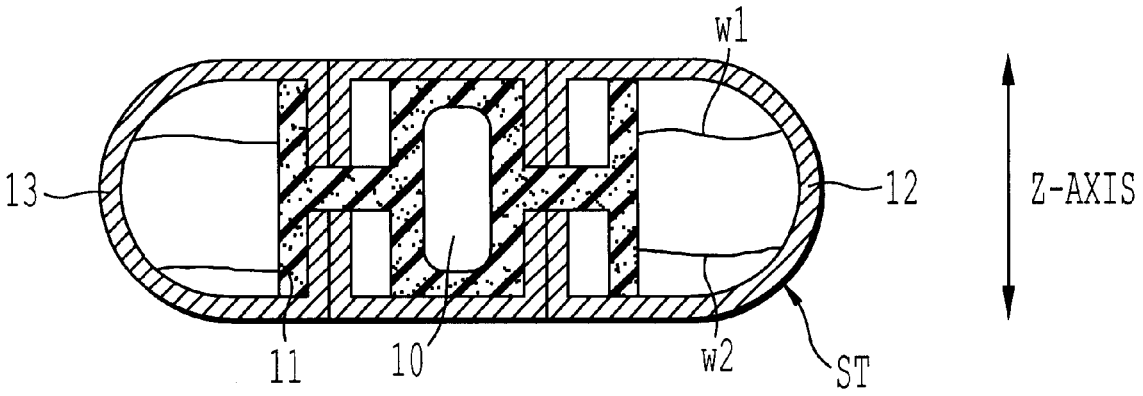
FIG. 2(*a*) is a cross-sectional view of a steam water tank of the beauty appliance which is rotated 90° around an X-axis.

Referring to FIG. 1, a beauty appliance (A), for example, for hair styling and facial treatment, includes a steam ejection device (a) and a mist ejection device (b). The beauty appliance (A) is, for example, a hair dryer with a brush, an apparatus for skin treatment, facial treatment, and the like. The steam ejection device (a) includes a steam generating chamber 9, a steam water tank (ST) and water absorbing material 11. The water absorbing material 11 is, for example, nonwoven fabric such as a felt, porous material such as sponge rubber, resin and the like. The steam generating chamber 9 contains a heater 10, for example, a PCT heater. The porous material 11 is provided to surround the circumferential surface of the heater 10. The steam water tank (ST) is positioned to cover the sides of the steam generating chamber 9 and is divided, for example, into a left tank 12 and a right tank 13. The porous material 11 extends into the tanks (12 and 13) through side-walls (14 and 15) such that a part of the porous material 11 is positioned in the tanks (12 and 13). Accordingly, the porous material 11 connects the steam generating chamber 9 and the tanks (12 and 13). The porous material 11 and the tanks (12 and 13) are connected so as not to form gaps between the outer circumference of the porous material 11 and the outer circumference of the tanks (12 and 13). Hence, water stored in the tanks (12 and 13) does not leak. The porous material 11 in the tanks (12 and 13) extends along a substantially entire height in a height direction (Y direction) of the tanks (12 and 13). Further, the porous material 11 in the tanks (12 and 13) extends along a substantially entire width in a width direction (Z direction) of the tanks (12 and 13) (see FIG. 2*a*). The tanks (12 and 13) have apertures (21 and 22), respectively, for supplying water. Detachable sealing caps (23 and 24) are provided to seal the water stored in the tanks (12 and 13). Pressure adjustment valves (25 and 26) are provided in the tanks (12 and 13), respectively. The valves (25 and 26) are configured to open when the amount of the water in the tanks (12 and 13) reduces and thus the pressure difference between the pressure in the tanks (12 and 13) and the atomospheric pressure is larger than a predetermined threshold pressure difference. On the other hand, the valves (25 and 26) are configured to close when the pressure difference is less than or equal to the predetermined threshold pressure difference. A steam ejection nozzle 17 is provided at an end of a passage 16.

The mist ejection device (b) includes a mist liquid tank 18 and a liquid passage 19. The liquid passage 19 is hermetically connected to the mist liquid tank 18. One end of the passage 19 extends to the approximate center portion (s) of the mist liquid tank 18. Another end of the passage 19 is hermetically connected to a mist ejection nozzle 20. The nozzle 20 is positioned near the steam ejection nozzle 17 so that the Venturi effect may be used. The tank 18 has an aperture 27 for supplying water. A detachable sealing cap 28 is provided in the aperture 27 to seal the water stored in the tank 18. A pressure adjustment valve 29 is provided on an upper wall of the tank 18. The valve 29 is configured to open when the amount of the water in the mist liquid tank 18 reduces and thus the pressure difference between the pressure in the mist liquid tank 18 and the atomospheric pressure is larger than a predetermined threshold pressure difference. On the other hand, the mist liquid tank 18 is configured to close when the pressure difference is less than or equal to the predetermined threshold pressure difference.

Following is an example of how the above-described beauty appliance (A) operates. Water is supplied to the tanks (12 and 13) through the apertures (21 and 22), respectively. The water stored in the tanks (12 and 13) is sealed by the seal caps (23 and 24), respectively. Water is also supplied to the mist liquid tank 18 through the aperture 27 and the water stored in the tank 18 is sealed by the seal cap 28. The porous material 11 absorbs the water in the tanks (12 and 13) through the capillary action. The water absorbed in the porous material 11 is heated by the heater 10 to generate steam in the steam generating chamber 9. The pressure in the steam generating chamber 9 increases as more steam is generated. The pressurized steam passes through the open passage 16 and is ejected through the steam ejection nozzle 17. At the same time, vacuum pressures generated according to the Bernoulli theorem cause the Venturi effect. Because of the Venturi effect, the liquid in the mist liquid tank 18 is drawn into the mist ejection nozzle 20. Then, the pressurized steam blows the liquid, thereby mixing the steam and the mist and ejecting them through an ejection tip 30.

The amount of the generated steam is controlled by adjusting the contacting area between the porous material 11 and the heater 10. For example, the larger the contacting area is, the more steam is generated. In order to increase the generation amount of mist or to generate smaller mist particles, it is necessary to increase the ejection velocity of the steam ejected through the steam ejection nozzle 17, since the nozzle 17 draws the mist by the Venturi effect. To increase the ejection velocity, the steam pressure in the steam generating chamber 9 may be increased by increasing the amount of the generated steam. Alternatively, the ejection velocity at the ejection nozzle 17 may be increased without increasing the steam generation amount. For example, by making the cross-sectional area of a steam ejection tip 32 smaller, the steam pressure in the steam generating chamber 9 increases. Accordingly, the steam ejection velocity increases.

The amount of the generated mist is controlled by adjusting the cross-sectional area and the length of the liquid passage 19. Also, the generation mist amount is controlled by adjusting the cross-sectional area and the length of the mist ejection tip 31 of the mist ejection nozzle 20. When the amount of the water in the tanks (12 and 13) and the liquid in the mist liquid tank 18 reduces, the pressures in the tanks (12 and 13) and the mist liquid tank 18 reduce accordingly. However, the pressure adjustment valves (25, 26 and 29) restore the pressures in the tanks (12 and 13) and the mist liquid tank 18, respectively, to the predetermined pressure. The water in the tanks (12 and 13) and the liquid in the mist liquid tank 18 reduces as time elapses. For example, the initial water level (w1) reduces to a water level (w2) after a certain time has elapsed. Since water contacts the porous material 11 at both water levels (w1) and (w2) in the tanks (12 and 13), the porous material 11 keeps absorbing water by the capillary action and continuously supplies steam until the water in the tanks (12 and 13) is almost gone. The tip of the liquid passage 19 extends to, for example, a water level (w4) in the mist liquid tank 18. Thus, the liquid passage 19 may draw the water in the mist liquid tank 18 to the mist ejection nozzle 20 until the level of the water in the tank 18 reduces from the initial water level (w3) to the level (w4). After the water level goes down below (w4), the tip of the liquid passage 19 is separated from the water surface and thus unable to draw water. Accordingly, a certain amount of water is left in the mist liquid tank 18 without being drawn to the liquid passage 19.

Following are examples of how the above-described appliance (A) operates when it rotates around a certain axis at certain degrees. When the appliance (A) rotates 360 degrees around the axis (Y), 180 degrees around the axis (X), or 180 degrees around the axis (Z), the appliance (A) operates similarly to the appliance (A) which is in a position shown in FIG. 1.

Figure 2B:
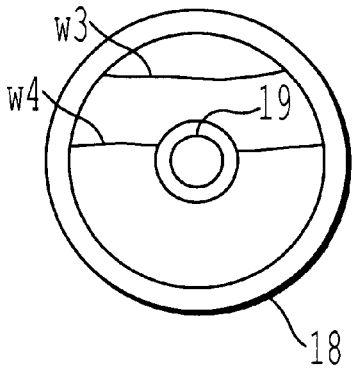

FIGS. 2(*a*) and 2(*b*) show a cross-sectional view when the appliance (A) rotates 90 degrees around the axis (X). For example, as shown in FIG. 2(*a*), the level of the water in the tanks (12 and 13) reduces from the initial level (w1) to a level (w2) as time passes. Since the water in the tanks (12 and 13) contacts the porous material 11 at both levels (w1) and (w2), the water is supplied to the porous material 11 by the capillary action regardless of the water level. Thus, steam is continuously generated until the water in the tanks (12 and 13) is almost gone. In the mist liquid tank 18, as shown in FIG. 2(*b*), for example, since the tip of the liquid passage 19 is in the liquid until the liquid level reduces to a level (w4), the passage 19 may draw the liquid into the mist ejection nozzle 20. However, after the liquid level goes down below (w4), the tip of the passage 19 is separated from the liquid surface, and unable to draw the liquid. Accordingly, a certain amount of water is left in the mist liquid tank 18.

Figure 3A:
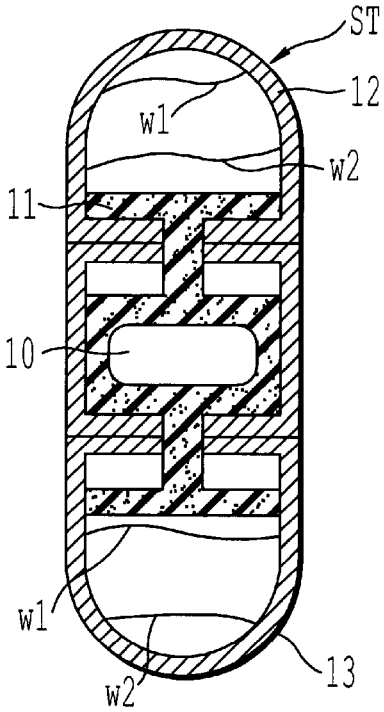
FIG. 3(*a*) is a cross-sectional view of a steam water tank of the beauty appliance which is rotated 90° around a Z-axis.
Figure 3B:
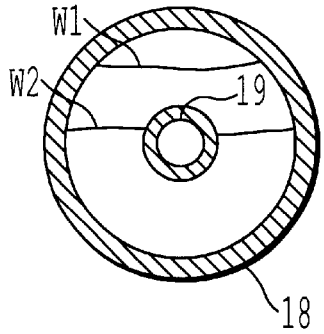
Figure 4:
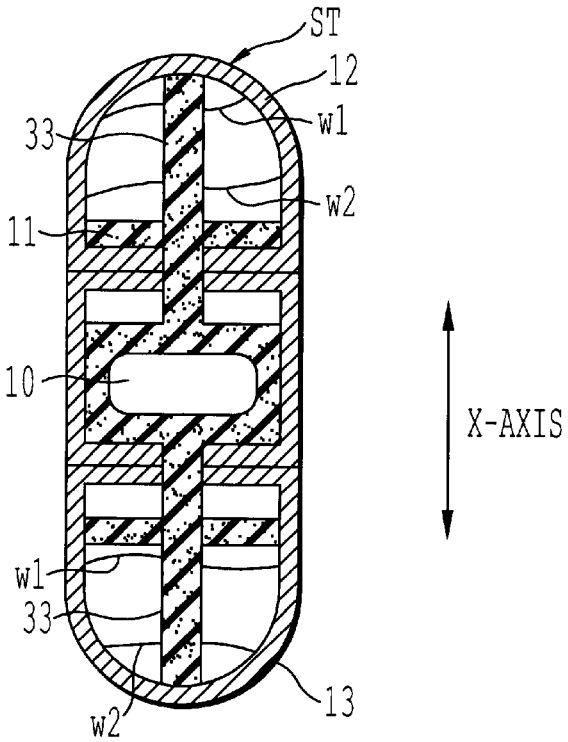
FIG. 4 is a cross-sectional view of a steam water tank of a beauty appliance according to another embodiment of the present invention.

FIGS. 3(*a*) and 3(*b*) show a cross-sectional view when the appliance (A) rotates 90 degrees around the axis (Z). For example, as time passes, the level of the water in the tank 12 reduces from the initial level (w1) to a level (w2). Since the water in the tank 12 contacts the porous material 11 at both levels (w1) and (w2), the water is supplied to the porous material 11 by the capillary action regardless of the water level. Thus, steam is continuously generated until the water in the tank 12 is almost gone. On the other hand, in the tank 13, the porous material 11 is separated from the water surface and cannot absorb water. To avoid this situation, as shown in FIG. 4, the porous material 11 includes, for example, an extended portion 33 which extends along the (X) axis (a depth direction) into the tanks (12 and 13). Accordingly, the extended portion 33 the porous material 11 is always submerged in the water. The mist liquid tank 18 in this embodiment operates similarly to that shown in FIG. 2(*b*) and thus, an explanation is omitted here.

As shown in FIG. 1, in order to use all the water in the tanks (12 and 13), the lowest point 43 of the porous material 11 is configured to be at or below the lowest water levels of the tanks (12 and 13). Accordingly, the beauty appliance (A) may operate regardless of the angle.

The number of the steam water tanks (ST) is at least one. By increasing the number of the steam water tanks, more water is supplied to generate more steam.

Figure 5:
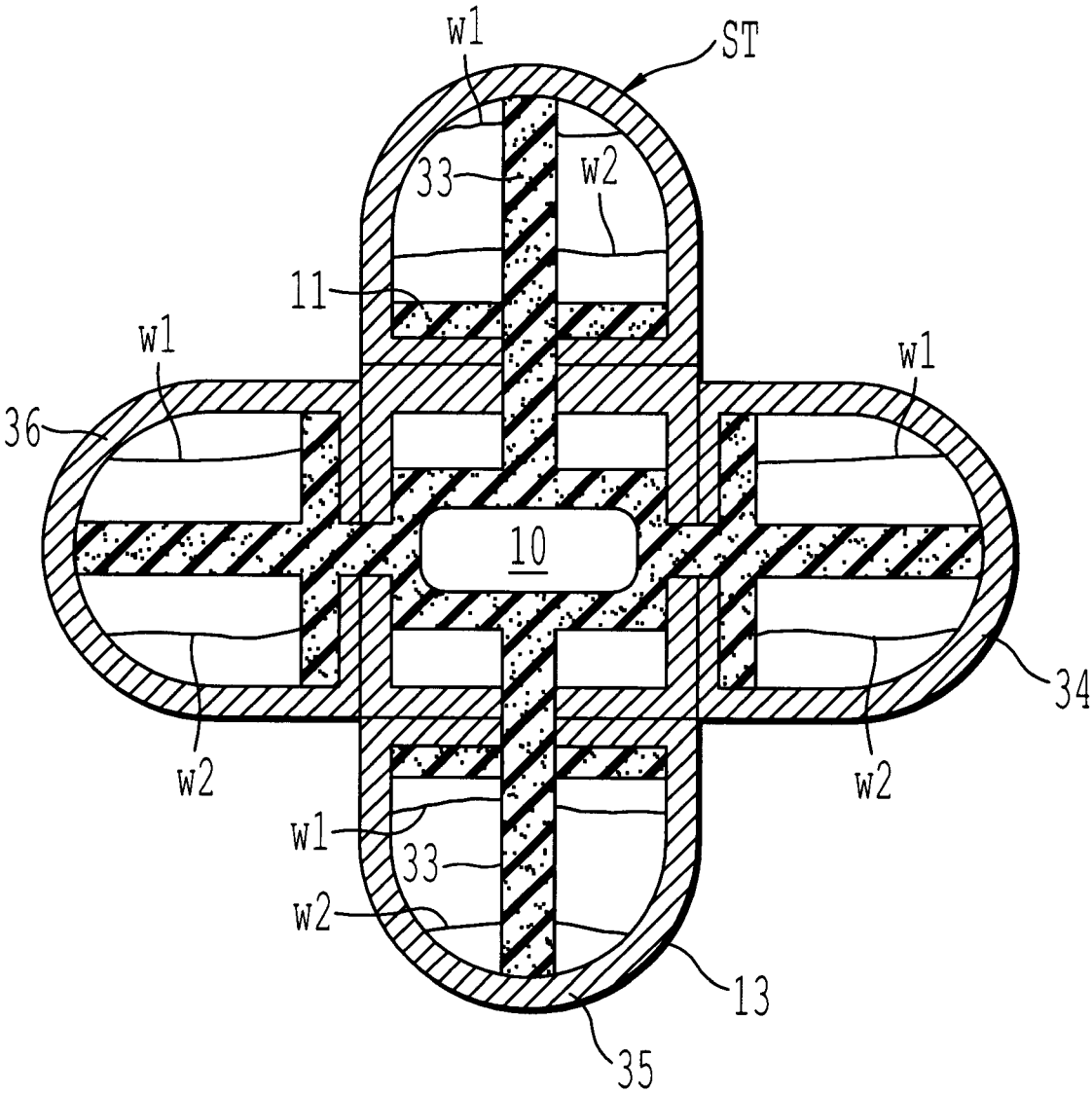
FIG. 5 is a cross-sectional view of a steam water tank of a beauty appliance according to the other embodiment of the present invention.

FIG. 5 shows the steam water tank (ST) which is divided into four compartments. The four steam compartments (34, 35, 36 and 37) are separated from each other.

In this embodiment, the beauty appliance (A) may operate efficiently regardless of its angle. More steam is generated from the four steam water tanks. The steam temperature may be lowered. Because of the four steam water tanks, moisture may be kept more efficiently while reducing the risk of burning hair or skin, for example. By adding medicine or conditioning lotions in the mist liquid tank 18, the beauty appliance (A) may be used for skin care or hair treatment, and the like.

Figure 6:
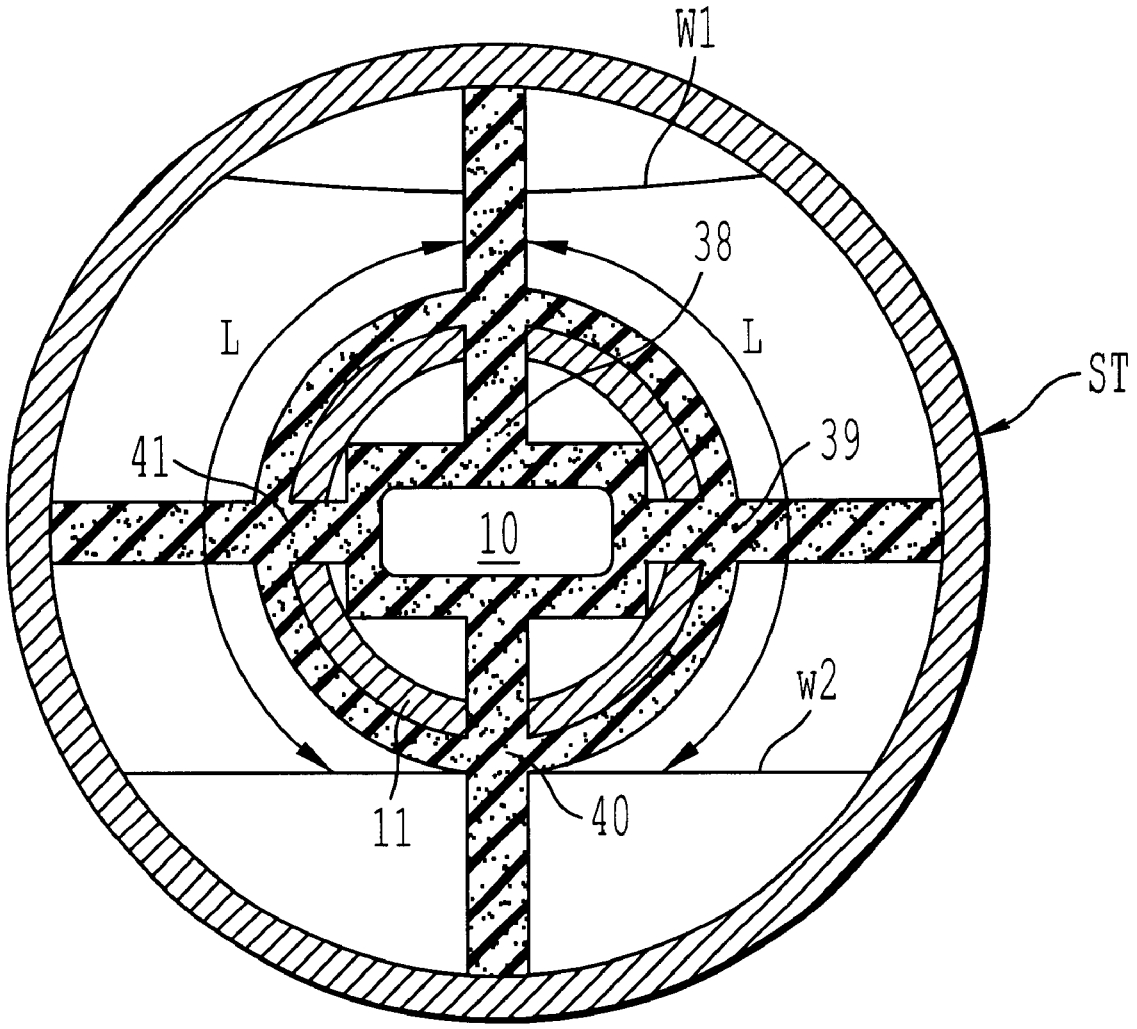
FIG. 6 is a cross-sectional view of a steam water tank of a beauty appliance according to another embodiment of the present invention.

FIG. 6 shows that the four steam compartments of the steam water tank (ST) in FIG. 5 are connected to each other. Referring to FIG. 6, a desired amount of steam may be obtained at the initial water level (w1). However, as the water level reduces to a lower level (w2), the respective water supplies to respective extended portions (38, 39, 40, and 41) of the porous material 11 become different and steam generated in the steam water tank (ST) reduces. This is because the porous material 11 absorbs water by the capillary action. The amount of water absorbed in the porous material 11 depends on the distance between the water level (w2) and the extended portions (38, 39, 40 and 41), respectively. For example, the distance (L) between the portion 38 and (w2) is the longest and thus the least amount of water is absorbed. The distance between the portion 40 and (w2) is the shortest and thus the largest amount of water is absorbed. Water absorbing amount at the portions 39 and 41 is between the water absorbing amount at the portion 40 and the water absorbing amount at the portion 38.

In the beauty appliance (A) according to the present embodiment of the present invention, only steam may be ejected from the beauty appliance (A) by shutting down the liquid passage 19. However, when high temperatures of the steam ejection are concerned, the empty mist liquid tank 18 is operated without shutting down the liquid passage 19 so that the air through the passage 19 may lower the temperature of the steam through the ejection nozzle 17. Alternatively, for example, the pressure adjustment valve 29 is opened. Thus, the temperature of the steam through the steam ejection nozzle 17 is lowered when the steam mixes with air coming through the pressure adjustment valve 29. Even when steam through the ejection nozzle 17 is mixed with either mist or air, the temperature of the steam is lowered. Therefore, a user uses the beauty appliance (A) more safely. Namely, if the liquid in the mist liquid tank 18 runs out while the beauty appliance (A) is in use, the mist ejection nozzle 20 draws air instead of liquid, and the temperature of the steam does not rise. Also, certain scents may be added to the mist liquid tank 18 to enhance relaxation effects.

According to the above embodiments of the present invention, ejection flow of the steam in the steam ejection nozzle causes a flow of the liquid toward the mist ejection nozzle from the mist liquid tank. Namely, in order to inject the mist, the vacuum pressure caused by the ejection flow of the steam in the steam ejection nozzle (the Venturi effect) is utilized. Accordingly, the structure of the beauty appliance (A) may be simplified, since no power source is necessary when supplying liquid or air to the mist ejection nozzle 20.

Further, according to the above embodiments of the present invention, steam may be ejected steadily regardless of the angle or posture of the beauty appliance (A).

Figure 7:
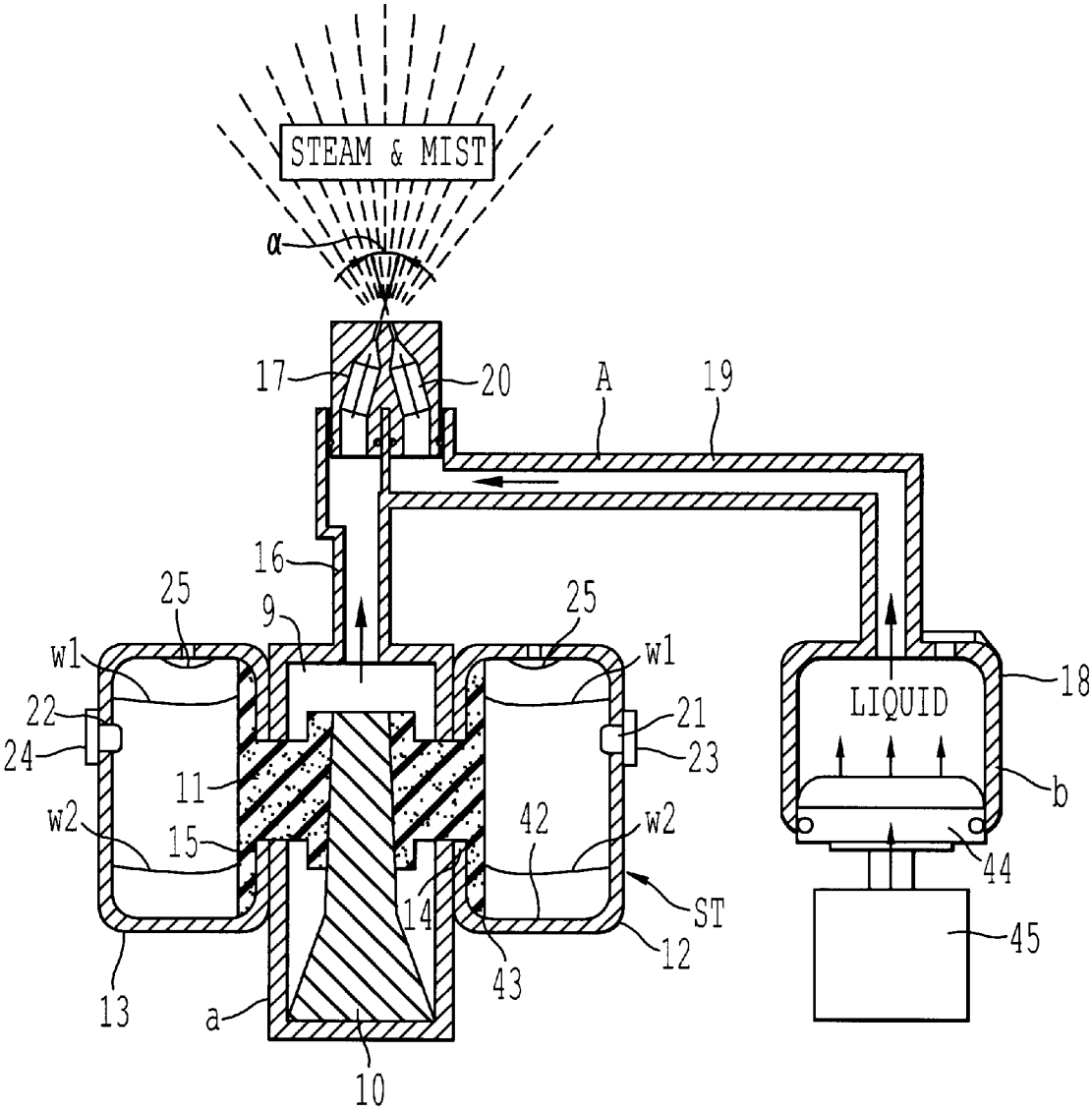
FIG. 7 is a cross-sectional view of a beauty appliance according to another embodiment of the present invention.

Yet another embodiment is shown in FIG. 7. In this embodiment, the liquid is separately drawn from the liquid tank (b) to the passage 19 without using the Venturi effect. The mist ejection nozzle 20 is positioned near the steam nozzle 17 at a certain angle of α and hermetically connected to the passage 19. The other end of the passage 19 is hermetically connected to the mist liquid tank 18. A piston 44 is hermetically provided in the mist liquid tank 18 to be slidably movable within the tank 18. A power source 45 is connected to the piston 44. Since the structure of the steam ejection device (a) in the present embodiment is similar to that in the embodiment shown in FIG. 1, each part is assigned the same reference numeral and the explanation is omitted here.

In the embodiment shown in FIG. 7, the liquid in the mist liquid tank 18 is pushed out by the piston 44, passes the liquid passage 19 and is ejected through the mist ejection nozzle 20. The amount of the mist is controlled by adjusting the pressure applied by the piston 44. The mist ejection nozzle 20 and the steam ejection nozzle 17 are positioned at a predetermined angle α so as to mix the steam and the mist efficiently.

In this embodiment, in addition to an effect obtained in the embodiment shown in FIG. 1, the mist liquid tank 18 may be solely used regardless the use of the steam ejection device. Accordingly, for example, the user may use the steam to warm and use the mist to cool. The beauty appliance (A) of this embodiment may be used for a wider range of purposes, since the steam water tank (ST) and the mist liquid tank 18 may be used either together or separately. Although the piston 44 is utilized to discharge the liquid from the mist liquid tank 18 in this embodiment, a pump may be used instead of the piston 44.

Figure 8:
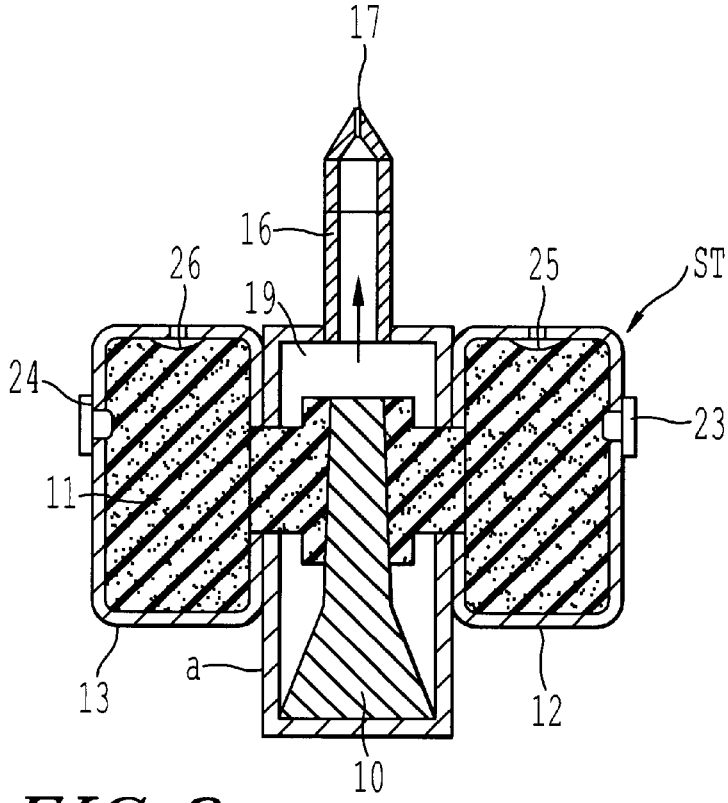
FIG. 8 is a cross-sectional view of a steam ejection device of a beauty appliance according to another embodiment of the present invention.

Another embodiment of the steam water tank (ST) is shown in FIG. 8. Referring to FIG. 8, the porous material 11 fills tanks (12 and 13) of the steam water tank (ST). The porous material 11 absorbs a predetermined amount of water to keep supplying water to the heater 10 while the beauty appliance (A) is used. Therefore, in this embodiment, the beauty appliance (A) may be used regardless of the angle of the beauty appliance (A) with respect to the (X, Y or Z) axes. Accordingly, the appliance (A) of this embodiment may be applied to, for example, a portable device such as a hair dryer with a brush.

Figure 9:
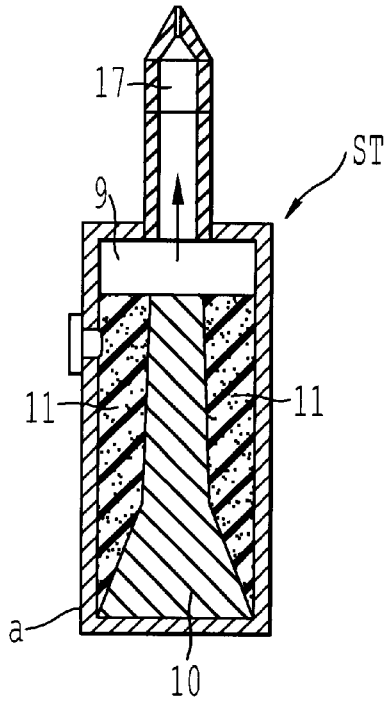
FIG. 9 is a cross-sectional view of a steam ejection device of a beauty appliance according to the other embodiment of the present invention.

Another embodiment of the steam ejection device (a) is shown in FIG. 9. In this embodiment, the steam ejection device (a) does not include the steam water tank (ST). The porous material 11 is provided to surround the heater 10 and fill the steam generating chamber 9. The beauty appliance (A) of this embodiment may have similar effects to those in the above embodiment referred to in FIG. 8, since the porous material 11 absorbs a predetermined amount of water and keeps supplying water to the heater 10. Also, since the steam ejection device (a) does not include the steam water tank (ST), appliance (A) may be smaller in size.

Figure 10A:
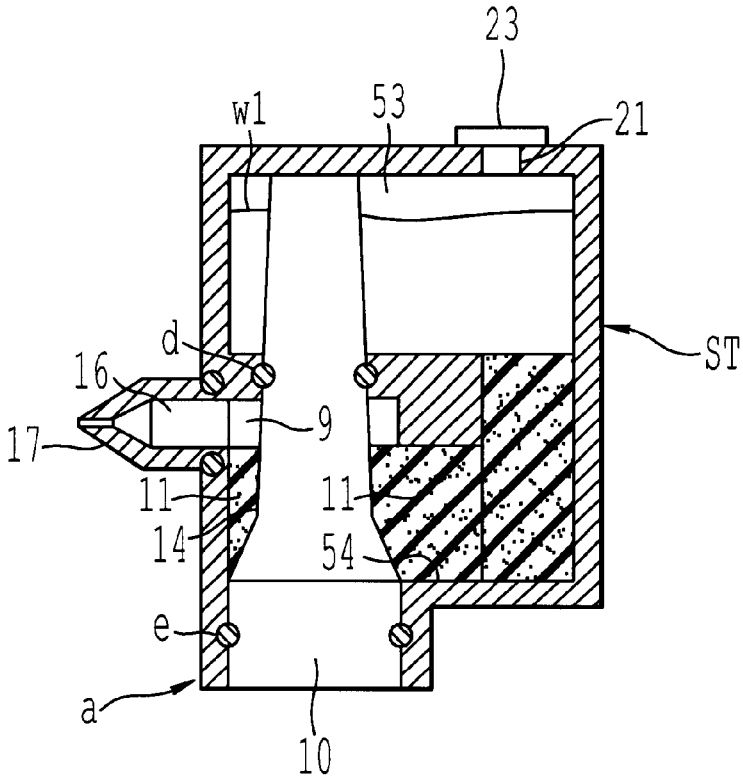
FIGS. 10(*a*) and 10(*b*) are cross-sectional view of a steam ejection device of a beauty appliance according to another embodiment of the present invention.
Figure 10B:
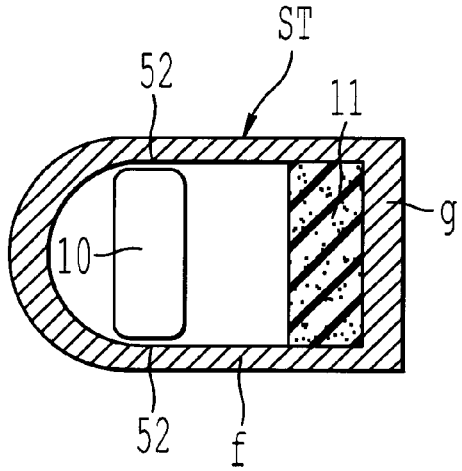

Yet another embodiment of the steam ejection device (a) is shown in FIGS. 10(*a*) and 10(*b*). The steam water tank (ST) contains the heater 10. O-rings (d and e) are provided to seal gaps between the steam water tank (ST) and the heater 10. The porous material 11 is provided to surround the circumferential surface of the heater 10 in the steam generating chamber 9. The porous material 11 extends to the steam water tank (ST) such that a part of -the porous material 11 is positioned inside the steam water tank (ST). Accordingly, the porous material 11 connects the steam generating chamber 9 and the tank (ST). The steam water tank (ST) includes a water storage chamber 53. The porous material 11 is provided in the steam water tank (ST) so as not to form gaps between the outer circumference of the porous material 11 and the inner circumference of the tank (ST). Accordingly, water in the water storage chamber 53 does not leak between the outer circumference of the porous material 11 and the inner circumference of the tank (ST). The porous material 11 in the steam water tank (ST) is provided to be along the side-wall 14 of the heater 10. The steam water tank (ST) has the aperture 21 for supplying water. The detachable sealing cap 23 is provided to seal the water stored in the tank (ST). The steam generating chamber 9 communicates with the outside of the beauty appliance (A) via a passage 16 and a steam ejection nozzle 17 which is provided at one end of the passage 16.

In the present embodiment, the water stored in the water storage chamber 53 is heated by the heater 10. Accordingly, the heated water changes to steam which pressurize the inside of the water storage chamber 53. This pressure in the water storage chamber 53 pushes the water stored in the water storage chamber 53 to the heater 10 through the porous material 11 to generate steam. The steam generated in the steam generating chamber 9 is pressurized as more steam is generated. The pressurized steam in the steam generating chamber 9 passes through the open passage 16 and is ejected through the steam ejection nozzle 17. The amount of the steam ejected through the nozzle 17 is in proportion to the amount of the water supplied to the heater 10 through the porous material 11. Thus, for example, the amount of the steam ejected through the nozzle 17 is controlled by adjusting the cross-sectional area and/or the length of a passage 54 which connects the steam generating chamber 9 and the water storage chamber 53. Also, since the water supply from the porous material 11 to heater 10 is in proportion to the pressure or the amount of steam generated in the water storage chamber 53, the amount of steam ejected through the ejection nozzle 17 is controlled by adjusting the contact area between the heater 10 and the storage chamber 53.

Comparing to a steam ejection device (a) which merely utilizes the capillary action to supply water to the heater, the steam ejection device (a) according to the present embodiment may supply more water to the heater. Accordingly more steam may be generated. Further, having only one tank, the appliance (A) in this embodiment may be small in size. Gaps 52 between the outer side surface of the heater 10 and the inner side wall of the steam water tank (ST) are formed as small as possible. Accordingly, when the appliance (A) is used in a position such that one side wall (f) is positioned at a lower side as shown in FIG. 10(*b*), the amount of the water left in the tank without being absorbed by the porous material 11 is as little as possible. When the appliance (A) is used in a position such that a rear wall (g) is positioned at a lower side, the heater 10 does not contact the water in the steam water tank (ST). In this situation, since the pressure in the storage chamber 53 does not increase, water may not be supplied to the heater 10 via the porous material 11. Namely, in this position, no steam is ejected. Thus, when no steam is desired while the beauty appliance (A) is in use, the appliance (A) is used in the position such that the rear wall (g) is positioned at a lower side. In this case, an amount of water stored in the steam water tank (ST) is limited so that the water does not contact the heater 10 when the appliance (A) is in the position such that the rear wall (g) is positioned at the lower side. To create these conditions, preferably, the cross-sectional shape of the heater 10 is, for example, rectangular or oval. In order to decrease the change in a steam supply amount depending on the posture of the beauty appliance (A), the preferred cross-sectional shape of the heater 10 is round. As described above, the gaps 52 are formed as small as possible in order that the amount of the water left in the tank without being absorbed by the porous material 11 is as little as possible. In this case, however, since the amount of the water stored in the chamber 53 decreases, the size of the tank should be increased to maintain the possible usage time.

Figure 11:
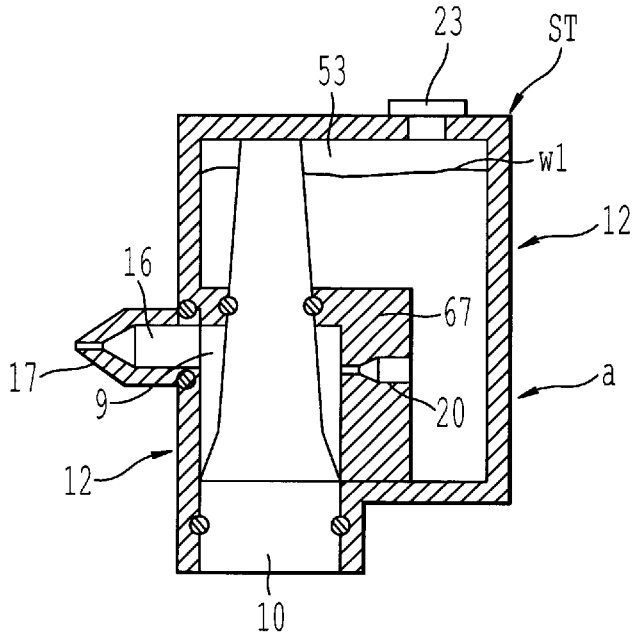
FIG. 11 is a cross-sectional view of a steam ejection device of a beauty appliance according to the other embodiment of the present invention.

Yet another embodiment of the steam water tank (ST) is shown in FIG. 11. The steam water tank (ST) of this embodiment has a heater 10 and the steam generating chamber 9. The steam ejection nozzle 17 is connected to the steam generating chamber 9. A partition wall 67 is provided to separate the steam generating chamber 9 and the steam water tank (ST). A mist ejection nozzle 20 is provided in the partition wall 67 so as to inject the mist toward the steam generating chamber 9. In this embodiment, the water in the storage chamber 53 of the steam water tank (ST) is separated from the steam generating chamber 9 by the partition wall 65 and the water contacts the heater 10 as fine mist particles because of the mist ejection nozzle 20. As a result, the surface area of the water contacting the heater 10 increases remarkably. Therefore, because vaporization efficiency increases, the steam is generated more efficiently.

Figure 12:
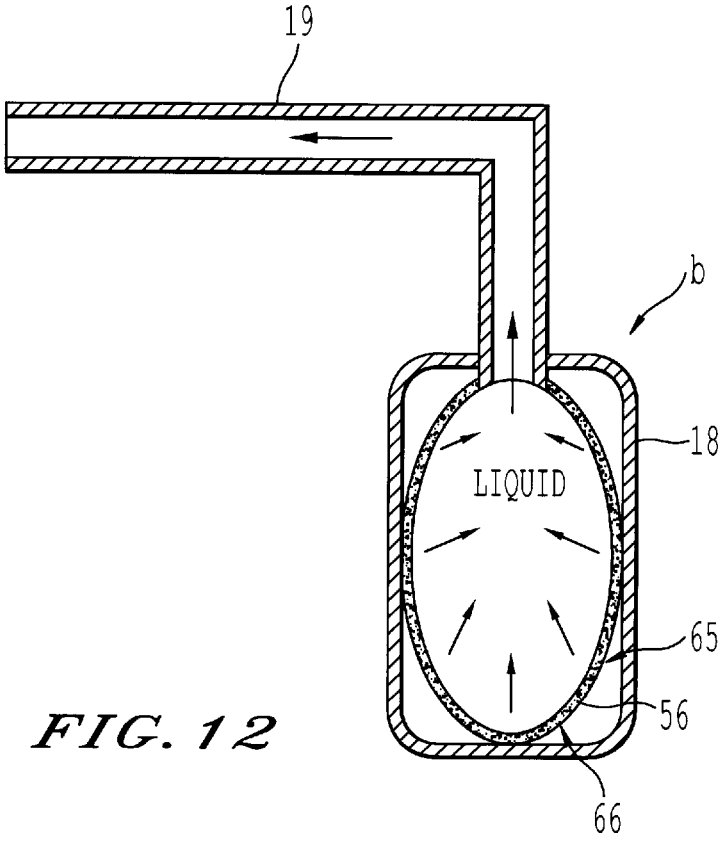
FIG. 12 is a cross-sectional view of a mist ejection device of a beauty appliance according to the other embodiment of the present invention.

Next, a mist liquid tank 18 according to another embodiment of the present invention is shown in FIG. 12. In the mist liquid tank 18 shown in FIG. 1, all the water in the mist liquid tank 18 may not be used and a certain amount of water is left in the mist liquid tank 18. Referring to FIG. 12, to improve this situation, a water retaining chamber 56 is provided in the mist liquid tank 18 and is connected hermetically to the liquid passage 19. The water retaining chamber 56 is made of elastically shrinkable material, for example, flexible material with low hardness such as rubber latex and the like. The water retaining chamber 56 has an aperture at a portion which is connected to the liquid passage 19. The amount of the liquid supplied to the chamber 56 is limited by the volume of the mist liquid tank 18. Thus, breakage of the water retaining chamber 56 due to internal and external stresses in the water retaining chamber 56 may be prevented.

In this embodiment, the amount of the liquid in the water retaining chamber 56 reduces as the mist ejection nozzle 20 draws the liquid from the water retaining chamber 56. When a certain amount of the liquid reduces, the equivalent volume of the chamber 56 also reduces. Namely, the water retaining chamber 56 also functions as a volume controller. Thus, the nozzle 20 may be able to draw almost all of the water in the water retaining chamber 56 and the beauty appliance (A) may be used at any angle.

Figure 13:
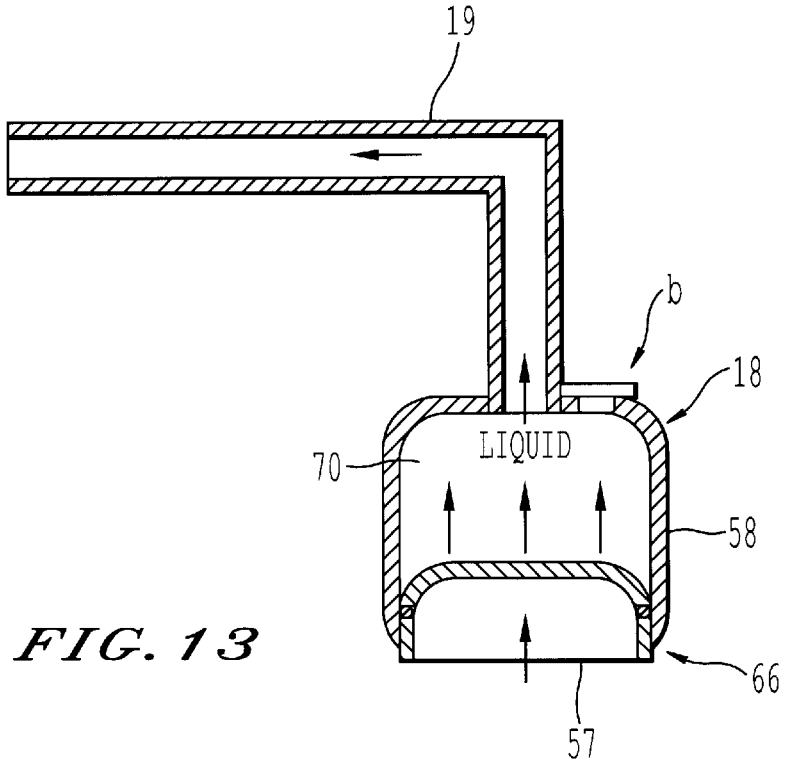
FIG. 13 is a cross-sectional view of a mist ejection device of a beauty appliance according to another other embodiment of the present invention.

A mist liquid tank 18 according to another embodiment of the present invention is shown in FIG. 13. The mist liquid tank 18 of this embodiment has an external container 58 in a cylindrical shape and an internal container 57 which is movably provided in the external container 58. A water storage chamber 70 is defined between the internal container 57 and the external container 58. The volume of the water storage chamber 70 changes according to the movement of the internal container 57. The internal container 57 is connected hermetically at the bottom circumference of the external container 58. The liquid passage 19 is hermetically connected to the external container 58.

In this embodiment, when a certain amount of liquid in the mist liquid tank 18 reduces, the internal container 57 moves upward to compensate the reduction in the liquid in the mist liquid tank 18. Accordingly, similar effects to the above-described embodiment may be expected and the nozzle 20 may draw most of the water in the internal container 58 and the beauty appliance (A) may be used at any angle.

Figure 14:
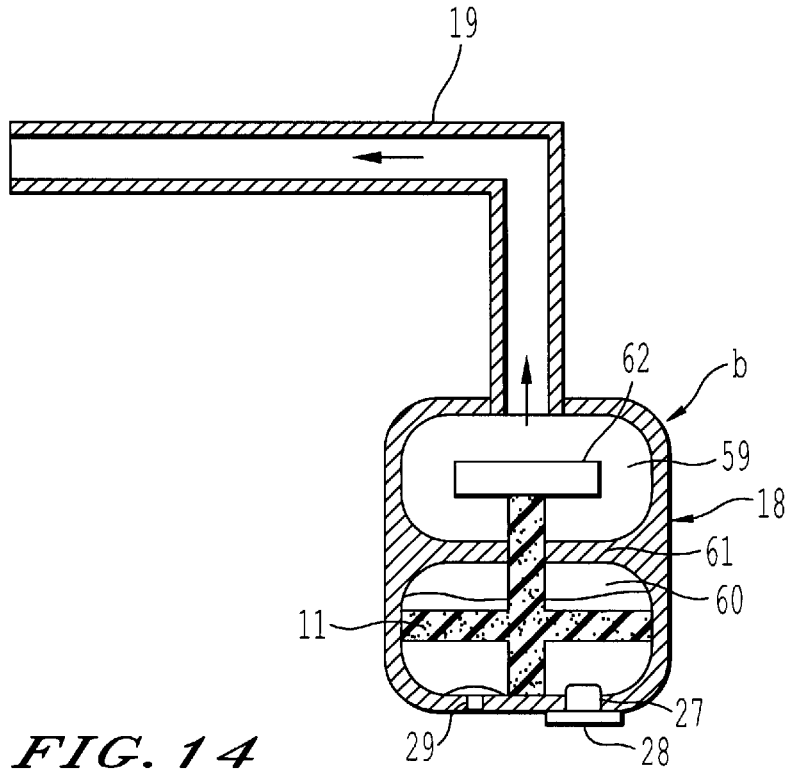
FIG. 14 is a cross-sectional view of a mist ejection device of a beauty appliance according to another embodiment of the present invention.

A mist liquid tank 18 according to another embodiment of the present invention is shown in FIG. 14. A partition wall 61 is provided in the mist liquid tank 18 to divide the mist liquid tank 18 into a mist generating chamber 59 and a water storage chamber 60. An ultrasonic vibrator 62 is provided in the mist generating chamber 59. The water storage chamber is configured to storage liquid, for example, water therein. A porous material 11 extends from the water storage chamber 60 to the mist generating chamber 59 and is configured to absorb the water. The ultrasonic vibrator 62 is provided to contact the porous material 11 and configured to vibrate the porous material to generate mist. The porous material 11 heretically contacts the partition wall 61 such that water does not leak.

In this embodiment, the porous material 11 absorbs the water in the storage chamber 60 by the capillary action and the extended part of the porous material 11 at the ultrasonic vibrator 62 generates mist in the mist generating chamber 59. The mist ejection nozzle 20 draws the mist and mixes it with the steam, thereby ejecting fine steam particles with lower temperatures. Since no separate power source such as a motor driven fan is not necessary to draw the mist to the mist ejection nozzle 20, the structure of this embodiment may be simplified.

Figure 15B:
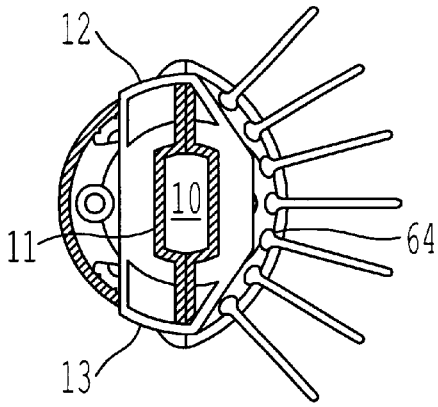
FIG. 15(*a*) is a cross-sectional view of a dryer with a brush according to another embodiment of the present invention.
Figure 15A:
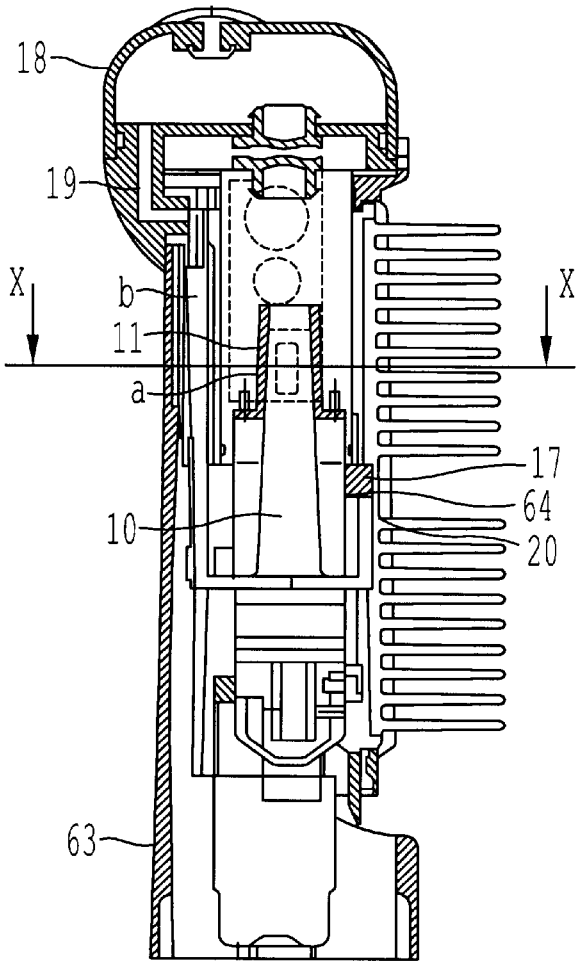
Figure 16:
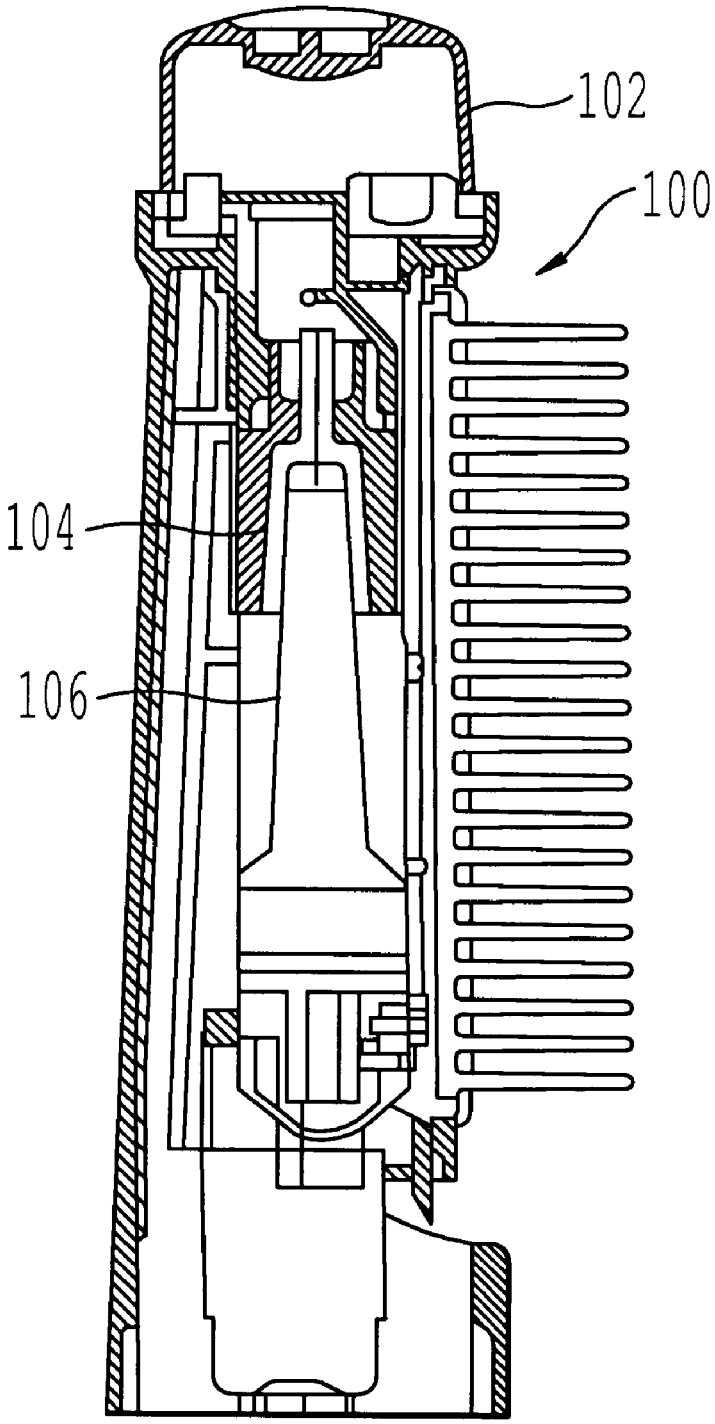
FIG. 16 BACKGROUND ART
FIG. 16 is a cross-sectional view of a dryer with a brush of a background art.

Next, a beauty appliance (A) according to another embodiment of the present invention is shown in FIG. 15. In this embodiment, a brush unit 64 includes a steam ejection device (a) and a mist ejection device (b). Steam and mist are ejected from the brush unit 64. Since the ejected steam and mist directly target the hair, for example, the appliance (A) may be used more efficiently, and the percentage of the ejected mist stuck on the hair may become higher. The steam ejected from the beauty appliance (A) includes enough mist. Accordingly, hair may be treated well. Also, the beauty appliance (A) of this invention may be used as a device for facial treatment, for example.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A beauty appliance comprising:

a steam ejection device comprising:

a steam water tank configured to contain water therein;

a heater configured to heat the water to generate steam; and a steam ejection nozzle through which the steam is ejected; and a mist ejection device comprising:

a mist liquid tank configured to contain liquid therein; and a mist ejection nozzle positioned in relation to the steam ejection nozzle such that ejection flow of the steam in the steam ejection nozzle causes a flow of the liquid toward the mist ejection nozzle from the mist liquid tank and the liquid to be ejected as mist.

2. A beauty appliance according to claim 1, further comprising:

a brush in which the steam ejection nozzle and the mist ejection nozzle are provided.

3. A beauty appliance according to claim 1, wherein the steam ejection device comprising:

a steam generating chamber connected to the steam ejection nozzle; and a water absorbing material extending from the steam water tank to the steam generating chamber, the heater being configured to heat the water absorbing material in the steam generating chamber to generate the steam.

4. A beauty appliance according to claim 3, wherein the water absorbing material comprises a porous material.

5. A beauty appliance according to claim 3, wherein the steam water tank is provided to surround a circumferential side surface of the steam generating chamber.

6. A beauty appliance according to claim 3, wherein the heater is provided in the steam generating chamber to contact the water absorbing material such that an area in which the heater contacts the water absorbing material is determined according to a generating amount of the steam.

7. A beauty appliance according to claim 1, wherein the mist liquid tank is connected to the mist ejection nozzle via a liquid passage, a sectional area and a length of the liquid passage being determined according to a generating amount of the mist.

8. A beauty appliance according to claim 1, wherein a sectional area and a length of the mist ejection nozzle are determined according to a generating amount of the mist.

9. A beauty appliance according to claim 3, wherein the water absorbing material extends along a substantially entire height in a height direction (a Y-direction) of the steam water tank.

10. A beauty appliance according to claim 3, wherein the water absorbing material extends along a substantially entire width in a width direction (a Z-direction) of the steam water tank.

11. A beauty appliance according to claim 3, wherein the water absorbing material extends along a substantially entire depth in a depth direction (an X-direction) of the steam water tank.

12. A beauty appliance according to claim 1, wherein the steam water tank includes a plurality of water storage chambers.

13. A beauty appliance according to claim 3, wherein the steam water tank includes four water storage chambers each being positioned about every 90 degrees around the steam generating chamber.

14. A beauty appliance according to claim 3, wherein the water absorbing material is provided to fill the steam water tank.

15. A beauty appliance according to claim 1, wherein the steam ejection device comprising:

a steam generating chamber connected to the steam ejection nozzle; and a water absorbing material connecting the steam water tank and the steam generating chamber, the heater extending from the steam generating chamber to the steam water tank and being configured to heat the water contained in the steam water tank and the water absorbing material to generate the steam.

16. A beauty appliance according to claim 15, wherein the heater has a sectional shape which is a rectangular or an ellipse.

17. A beauty appliance according to claim 1, wherein the steam ejection device comprising:

a steam generating chamber connected to the steam ejection nozzle; and a water ejection nozzle provided between the steam water tank and the steam generating chamber and configured to inject as a mist the water contained in the steam water tank to the steam generating chamber, the heater being configured to heat the water contained in the steam water tank and the mist to generate the steam.

18. A beauty appliance according to claim 1, wherein the mist ejection device further comprising:

a liquid retaining chamber provided in the mist liquid tank and configured to contain liquid therein, the liquid retaining chamber being made of elastically shrinkable material and connected to the mist ejection nozzle.

19. A beauty appliance according to claim 1, wherein the mist liquid tank has a variable volume.

20. A beauty appliance according to claim 19, wherein the mist liquid tank has an internal container which is slidably movable along an inner circumferential surface of the mist liquid tank to change a volume in the mist liquid tank.

21. A beauty appliance according to claim 1, wherein the mist liquid tank comprises:

a mist generating chamber;

a liquid storage chamber configured to storage liquid therein;

a liquid absorbing material extending from the liquid storage chamber to the mist generating chamber and configured to absorb the liquid; and an ultrasonic vibrator provided in the mist generating chamber to contact the liquid absorbing material and configured to vibrate the liquid absorbing material to generate mist.

22. A beauty appliance comprising:

a steam ejection device comprising:

a steam venerating chamber;

a water absorbing material provided in the steam generating chamber and configured to absorb water;

a heater provided in the steam generating chamber and configured to heat the water absorbing material to generate steam; and a steam ejection nozzle which is connected to the steam generating chamber and through which the steam is ejected; and a mist ejection device comprising:

a mist liquid tank configured to contain liquid therein; and a mist ejection nozzle positioned in relation to the steam ejection nozzle such that ejection flow of the steam in the steam ejection nozzle causes a flow of the liquid toward the mist ejection nozzle from the mist liquid tank and the liquid to be ejected as mist.

23. A beauty appliance comprising:

a steam ejection device comprising:

a steam water tank configured to contain water therein;

a heater configured to heat the water to generate steam; and a steam ejection nozzle through which the steam is ejected; and an air ejection device comprising:

an air intake passage communicating with an atmosphere; and an air ejection nozzle which is connected to the air intake passage and which is positioned in relation to the steam ejection nozzle such that ejection flow of the steam in the steam ejection nozzle causes a flow of air toward the air ejection nozzle via the air intake passage.

24. A beauty appliance comprising:

a steam ejector device comprising:

a steam water tank configured to contain water therein;

a heater configured to heat the water to generate steam; and a steam ejection nozzle through which the steam is configured to be ejected; and a mist ejection device comprising:

a mist liquid tank configured to contain liquid therein; and a mist ejection nozzle positioned in relation to the steam ejection nozzle such that the liquid is caused to be ejected as mist and a mist amount ejected from the mist ejection nozzle depends on a flowing speed of the steam in the steam ejection nozzle.

25. A beauty appliance comprising:

a steam ejection device comprising:

steam water tank means for containing water therein;

heater means for heating the water to generate steam; and steam ejection means for ejecting the steam; and a mist ejection device comprising:

mist liquid tank means for containing liquid therein; and mist ejection means for ejecting the liquid as mist, the mist ejection means being positioned in relation to the steam ejection means such that ejection flow of the steam in the steam ejection means causes a flow of the liquid toward the mist ejection means from the mist liquid means and the liquid to be ejected as mist.

* * * * *

UNITED STATES PATENT AND TRADEMARK OFFICE

CERTIFICATE OF CORRECTION

PATENT NO. : 6,584,985 B2
DATED : July 1, 2003
INVENTOR(S) : Shingo Omura

It is certified that error appears in the above-identified patent and that said Letters Patent is hereby corrected as shown below:

Column 7,
Line 62, change “-the” to -- the --.

Column 10,
Line 16, change “heretically” to -- hermetically --.

Column 12,
Line 31, change “venerating” to -- generating --.

Signed and Sealed this

Fourth Day of May, 2004

JON W. DUDAS
*Acting Director of the United States Patent and Trademark Office*